US007437918B2

(12) United States Patent
Gilkerson

(10) Patent No.: US 7,437,918 B2
(45) Date of Patent: Oct. 21, 2008

(54) TRUCK INSPECTION TOOL

(76) Inventor: Robert H. Gilkerson, 25407 Figgs Rd., Seaford, DE (US) 19973

( * ) Notice: Subject to any disclaimer, the term of this patent is extended or adjusted under 35 U.S.C. 154(b) by 0 days.

(21) Appl. No.: 11/598,999

(22) Filed: Nov. 14, 2006

(65) Prior Publication Data

US 2008/0109966 A1 May 15, 2008

(51) Int. Cl.
*E01C 23/00* (2006.01)

(52) U.S. Cl. ..... 73/146

(58) Field of Classification Search ..... 73/146.8, 73/146.2, 146.3, 146, 143; 16/110.1; 362/202, 362/103; 7/143; 30/169
See application file for complete search history.

(56) References Cited

U.S. PATENT DOCUMENTS

| | | | | |
|---|---|---|---|---|
| 1,274,312 | A | 7/1918 | Nicoll | |
| 2,758,798 | A | 8/1956 | Schmidt | 224/904 |
| 3,696,668 | A * | 10/1972 | Patrick | 73/146.8 |
| 4,941,073 | A | 7/1990 | Bolton | 362/80.1 |
| 5,154,506 | A | 10/1992 | Leard | 362/103 |
| D348,319 | S | 6/1994 | Lewis | D26/41 |
| 5,353,208 | A * | 10/1994 | Moore | 362/202 |
| 5,386,592 | A | 2/1995 | Checkeroski | 2/209.13 |
| 5,601,356 | A * | 2/1997 | McWilliams | 362/103 |
| 5,752,633 | A | 5/1998 | Antaki | 224/222 |
| 6,341,423 | B1 * | 1/2002 | Taggart et al. | 30/169 |
| 7,124,470 | B2 * | 10/2006 | Alanis | 16/110.1 |
| 7,159,260 | B2 * | 1/2007 | Hansen | 7/143 |
| 2004/0084489 | A1 | 5/2004 | Murphey et al. | 224/221 |
| 2005/0082322 | A1 | 4/2005 | Dziubeck | 224/219 |

* cited by examiner

*Primary Examiner*—Jewel V Thompson
(74) *Attorney, Agent, or Firm*—John C. Andrade; Parkowski, Guerke and Swayze, P.A.

(57) ABSTRACT

The present invention is a Truck Inspection Tool. The tool is comprised primarily of a hollow steel cylindrical rod that is filled and weighted at one end and attached to a hub seal puller and at the other end has a pliant material and flashlight inserted within it. The tool as used is attached to an adjustable forearm strap and should include additional items such as a tire pressure gauge and a tire depth gauge. This tool is designed to decrease the time and difficulty of a truck inspection.

12 Claims, 3 Drawing Sheets

TRUCK INSPECTION TOOL

BACKGROUND OF THE INVENTION

1. Field of the Invention

This invention is a tool designed to introduce safety and speed into truck inspections. The invention works for both pre-trip and post-trip inspections of truck equipment.

2. Description of the Prior Art

A pre-trip safety inspection is required to be carried out by any driver holding a commercial driver's license. Typically the first step is to prepare checklists to substantiate every safety aspect of the vehicle prior to taking it on the road. The inspections increase the safety of the vehicle on the road and can also reduce the cost of repairs by catching problems when they are small before they become a major concern.

A typical inspection consists of checking under the vehicle's hood prior to starting the engine; checking the oil, radiator, and coolant levels; checking the belts and hoses for cracks, splits or worn spots; checking for loose wires or fluid leaks; checking for loose battery cables and corrosion; and starting the engine to look for leaking fluids. The next step would be typically to check the dashboard to see that it is lighting properly and that all gauges and indicators are working properly, testing the steering wheel for excessive play, testing the windshield wipers and washers for proper operation, sounding the horn and checking the seatbelts. With the engine still running, all the lights are turned on, for the headlights low and high beams, parking lights, brake lights, turn signals, emergency flashers, backup lights, clearance lights, and interior lights. Next, the suspension needs to be checked by observing that the vehicle is sitting lower on one side than on the other or in the back or in the front. Next, the tires are checked for proper inflation, cuts, bubbles, or other tire deformities. Tires are further checked for tread depth and wear. Next is to look for loose or hanging parts from the exhaust system, listen for unusual noises and look for scratches and dents. The doors and windows are checked for proper operation and seal and for broken or cracked glass. Prior to moving the vehicle it is necessary to test the brake system and check for sponginess in the pedal.

It is necessary to have a flashlight or some type of lighting source to complete the inspection.

U.S. Pat. No. 5,752,633 discloses a flashlight that can be removeably attached to the hand, arm, or leg. The 633 device however discloses only the attachment of a flashlight.

It is an object for the present invention to have a truck inspection tool that is effective for conducting pre-trip and post-trip inspections.

SUMMARY OF THE INVENTION

The Truck Inspection Tool of the present invention is designed to aid in pre-trip and post-trip truck inspections. The Tire Inspection Tool comprises a tire thumper comprised of a hollow rod having a front end and a rear end and a means for pulling hub seals, together with a small flashlight of sufficiently small outer diameter to fit within the front end of the hollow rod. The Tire Inspection Tool preferably has an adjustable forearm strap and a means for securing the Tire Inspection Tool to the forearm strap, typically by Velcro® hook and loop fasteners. The inspection tool should also include a tire pressure gauge, and a tire depth gauge attached to the forearm strap. Preferable means for securing the Tire Inspection Tool to the forearm strap would be through a metal clamp connected to the forearm strap. In the Tire Inspection Tool the means for pulling hub seals would be preferably a rigid piece having a first end rigidly connected to said rear end of said hollow rod and a second end, which is sufficiently thin, preferably ⅛" thick, to be suitable for pulling hub seals.

The Tire Inspection Tool would further preferably comprise a tire thumper having a hollow cylindrical rod having a front end and a rear end and having a cylindrically shaped inner wall further including a pliant material attached to the cylindrically shaped inner walls and acting as a cushion agent to cushion a flashlight having a sufficiently small outer diameter to fit within the inner walls of the hollow rod. The hollow rod would preferably include a solid and weighted portion attached to one end and the means for pulling hub seals would further preferably comprise a rigid hook-shaped piece having a base at a first end and a curved piece at the second end wherein the base is connected to the weighted rear end of the cylindrical rod and thin edge of the hub seal is at the curved end. It would further be preferable for the tire thumper to include a lanyard connected to it such that the lanyard could be wrapped around the wrist of the person conducting the truck inspection.

DESCRIPTION OF THE PREFERRED EMBODIMENT

Figure 1:
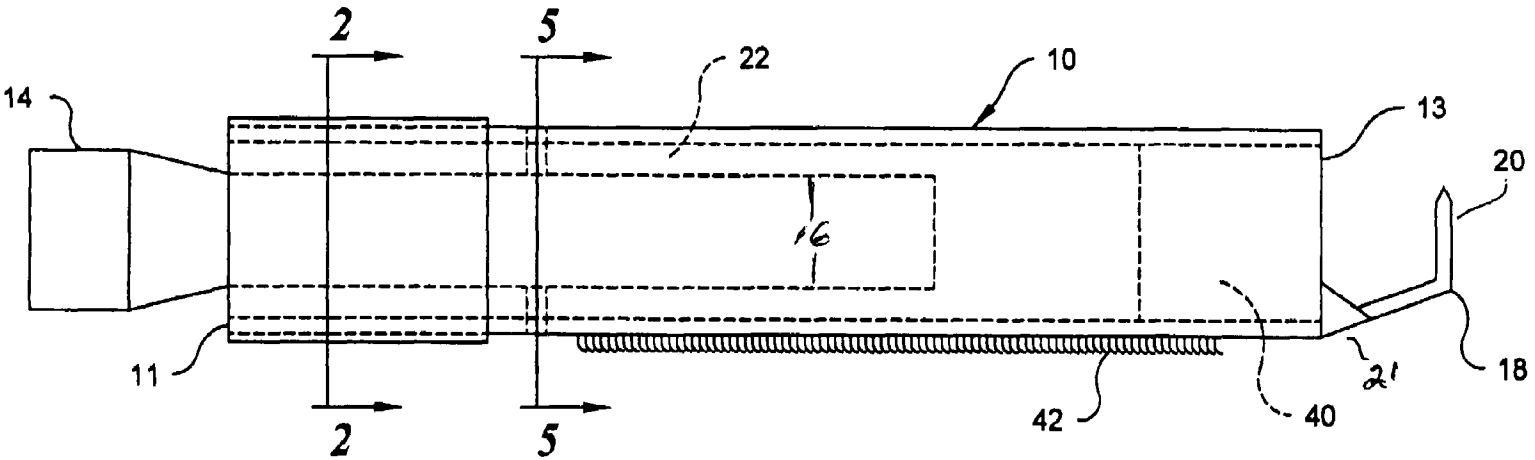
FIG. 1 is a perspective view of the Truck Inspection Tool without the adjustable forearm strap.

The cylindrical hollow rod 10 as shown in FIG. 1 is preferably made from steel and towards the rear end 13 should include a solid piece 40, preferably filled with lead. The purpose of the hollow cylindrical rod is to act as a tire thumper when checking tires. It is necessary that there is a sufficient rigidity and hardness to the tire thumper to make it effective in checking tires. It is also important to cushion the flashlight 14 and as such pliant material 22 such as rubber is used within the front end 11 of the hollow cylindrical rod 10 to cushion the flashlight 14 and absorb any impact from using the tool to check tires. The flashlight 14 has a sufficiently small outer diameter 16 to fit within the front end 11 of the hollow cylindrical rod 10. An important part of the inspection is to have a hub seal puller 18. Preferential shape of the hub seal puller 18 is shown in FIG. 1 wherein the hub seal puller 18 is a rigid piece and is shown as a first end 21 attached to the rear end 13 of the hollow rod and a curved piece which tapers down to a second end 20 with a thin edge which is necessary to be suitable as a hub seal puller. Also shown in FIG. 1 is the adhesive hook portion 42 which is adhered by an adhesive to the hollow rod 10 on one side and the other side are the hooks necessary for the Velcro® type attachment to attach to the loop portion 28 as shown in FIG. 3.

Figure 2:
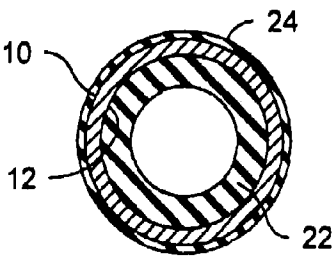
FIG. 2 is a cross-section view of the hollow rod and surrounding pliant material.

FIG. 2 is a cross-sectional view that shows the pliant material 22 cushioning the inside of the hollow rod 10. Also shown is the cylindrically shaped inner wall 12 of the hollow rod 10. Lastly, in FIG. 2 is further shown the outer pliant material 24 shown wrapped around the outside of the hollow rod 10.

Figure 3:
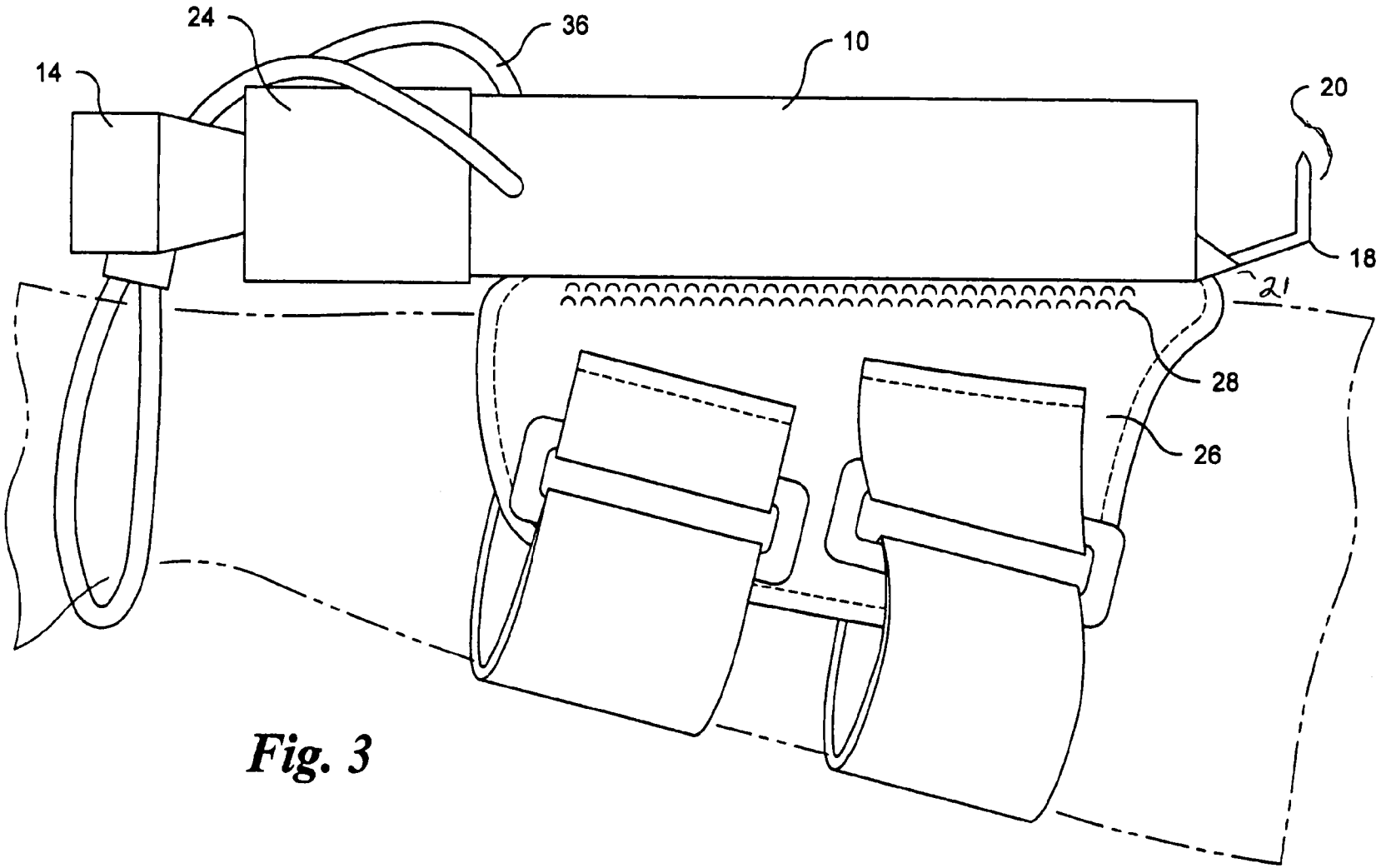
FIG. 3 is a perspective view of the Truck Inspection Tool including the adjustable forearm strap.

FIG. 3 shows the use of the adjustable forearm strap 26 and the loop fastener portion 28 of the armband. The hollow rod 10 or tire thumper is shown in the attached position and the lanyard 36 is shown in a position attached to a wrist with the flashlight 14 extending out past the looped over outer pliant material 24. At the end is shown the hub seal puller 18 and the thin edge of the hub seal puller 20.

Figure 4:
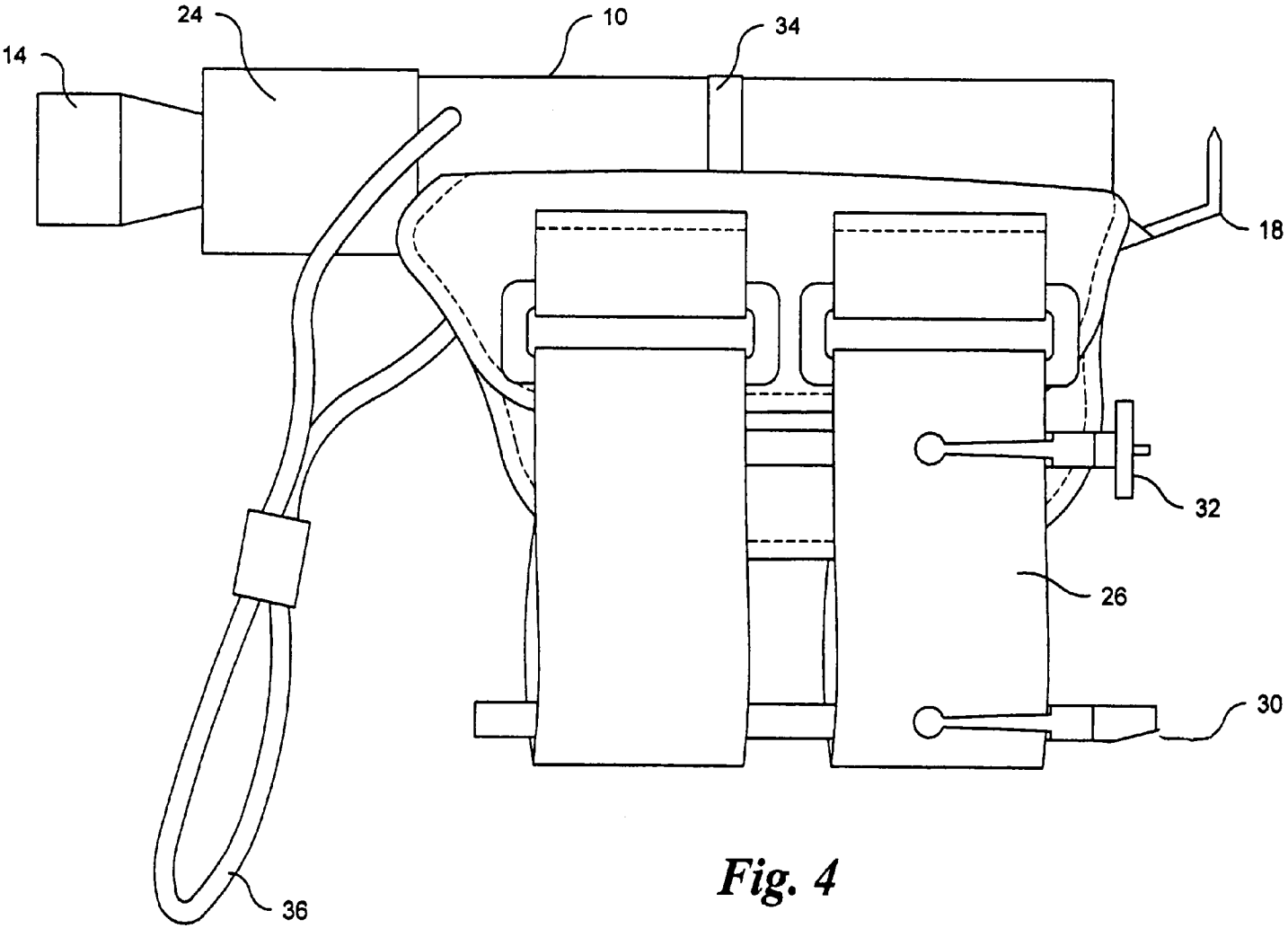
FIG. 4 is a perspective view of the Tire Inspection Tool.

FIG. 4 shows a metal clamp 34 that is rigidly connected to the adjustable forearm strap. The benefit of the metal clamp 34 is it will reduce the wear and is more effective in securing the hollow rod portion of the tool to the forearm strap. As part of the inspection, it is preferable to have the tire pressure gauge 30 and tire depth gauge 32 in order to fully conduct the inspection and they are shown as removably attached to the adjustable forearm strap.

Figure 5:
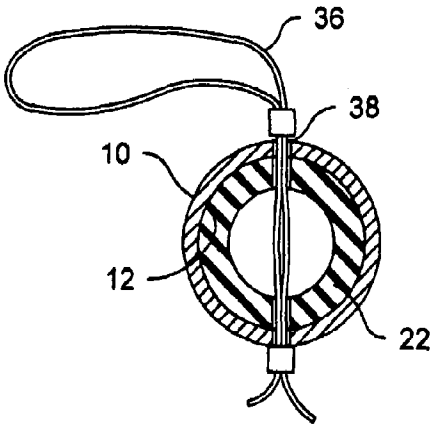
FIG. 5 is a cross sectional view of the hollow rod showing the lanyard attached.

FIG. 5 is another cross-sectional view of the hollow cylindrical rod 10, which further shows a drill hole 38 to fit the lanyard 36.

The Truck Inspection Tool gives the driver the tools he needs to do a thorough pre-trip or post-trip inspection of his equipment. Everything that is needed is in one place secured to the arm. The armband is adjustable to fit small or large arms. The hub seal puller can also be used to check the correct oil levels. The hub seal puller can also be used on the tires to pop out stones that get stuck in the treads of the tires and to break door seals. Using the tool at night is also convenient and lets the user use the tool with the light on rather than having to hold the light separately. Putting all of these separate tools into one easy tool will decrease the loss of tools and allow the truck inspection to be conducted much more efficiently. Another expected benefit is cutting the cost of road service, because defects will be discovered sooner. The Truck Inspection Tool can also be used with large RV's and with the addition of the tire pressure gauge and the tire depth gauge, it will be much more likely that individuals doing inspections will check their tires. The benefits therefore are safer operation and a much more efficient time effective inspection.

I claim:

1. A Tire Inspection Tool comprising:

(a) a tire thumper comprising a hollow rod having a front end and a rear end and a means for pulling hub seals; and (b) a small flashlight of sufficiently small outer diameter to fit within said front end of said hollow rod.

2. The Tire Inspection Tool of claim 1 further comprising an adjustable forearm strap and means for securing said tire inspection tool to said forearm strap.

3. The Tire Inspection Tool of claim 2 further comprising a tire pressure gauge and a tire depth gauge both removably attached to said forearm strap.

4. The Tire Inspection Tool of claim 2 wherein the means for securing said Tire Inspection Tool to said forearm strap is a metal clamp connected to said forearm strap.

5. The Tire Inspection Tool of claim 2 wherein said forearm strap is secured to itself by means of a hook and loop fastener.

6. The Tire Inspection Tool of claim 1 wherein the means for pulling hub seals comprises a rigid piece having a first end attached to said rear end of said hollow rod and a second end sufficiently thin to be suitable for pulling hub seals.

7. A Truck Inspection Tool comprising (a) a tire thumper comprising a hollow cylindrical rod having a front end and a rear end and having a cylindrical shaped inner wall (b) a means for pulling hub seals;

(c) a flashlight having a sufficiently small outer diameter to fit within said rod;

(d) an adjustable forearm strap;

(e) a means for securing said tire thumper to said strap.

8. The Truck Inspection Tool of claim 7 further comprising a pliant material attached to said cylindrical shaped inner walls of said cylindrical rod and acting as a cushioning agent to cushion said flashlight from said cylindrical rods inner walls.

9. The Truck Inspection Tool of claim 7 wherein said hollow rod is filled and weighted at said rear end.

10. The Truck Inspection Tool of claim 9 wherein the means for pulling hub seals comprises a rigid piece having a first end and a second end which is sufficiently thin to be suitable for pulling hub seals.

11. The Truck Inspection Tool of claim 10 wherein the said rigid piece is a hook shaped piece having a base at said first end and a curved piece at said second end wherein said base is connected to said solid weighted rear end of said cylindrical rod and said thin edge at said second end of said hook shaped piece.

12. The Truck Inspection Tool of claim 7 further comprised of a lanyard connected to said tire thumper, said lanyard suitable for wrapping around a wrist.

* * * * *